US009103590B2

(12) United States Patent
Hartwell et al.

(10) Patent No.: US 9,103,590 B2
(45) Date of Patent: Aug. 11, 2015

(54) DRYING TRAY AND METHOD OF USE

(75) Inventors: Warren R. Hartwell, Fall River, MA (US); Paul E. Bartley, Warren, RI (US)

(73) Assignees: Warren R. Hartwell, Fall River, MA (US); Paul E. Bartley, Warren, RI (US)

( * ) Notice: Subject to any disclaimer, the term of this patent is extended or adjusted under 35 U.S.C. 154(b) by 1660 days.

(21) Appl. No.: 12/272,181

(22) Filed: Nov. 17, 2008

(65) Prior Publication Data

US 2009/0126221 A1 May 21, 2009

Related U.S. Application Data

(60) Provisional application No. 60/988,242, filed on Nov. 15, 2007.

(51) Int. Cl.
*F26B 25/18* (2006.01)

(52) U.S. Cl.
CPC ..... *F26B 25/18* (2013.01)

(58) Field of Classification Search
CPC ..... F26B 11/22; F26B 25/18
USPC ..... 34/522, 238, 442, 511, 512, 93, 192, 34/194, 237, 239
See application file for complete search history.

(56) References Cited

U.S. PATENT DOCUMENTS

| | | | | |
|---|---|---|---|---|
| 3,085,352 | A * | 4/1963 | Hartle | 34/238 |
| 4,192,081 | A * | 3/1980 | Erickson et al. | 34/225 |
| D260,568 | S | 9/1981 | Cherry | |
| 4,329,789 | A * | 5/1982 | Erickson | 34/195 |
| 5,983,519 | A * | 11/1999 | Ferrari | 34/192 |
| 6,255,102 | B1 * | 7/2001 | Hallsten | 435/299.1 |
| 6,755,943 | B1 * | 6/2004 | Mizutani et al. | 203/99 |
| 7,024,797 | B2 * | 4/2006 | Bessa | 34/381 |

FOREIGN PATENT DOCUMENTS

| | | | | |
|---|---|---|---|---|
| FR | 996340 | A * | 12/1951 | A47C 23/20 |

OTHER PUBLICATIONS

Abstract of Mounier, FR996340A, Dec. 1951.*
Description of Mounier, FR996340A, Dec. 1951.*
"Sunsweet Dryers" Tray Drawing, 1977.
Photograph of "Wooden Tray With Fruit," date unknown.
Photograph of "Sun Drying Tomatoes" on trays, date unknown.
Photograph of "Sunkist Metal Frame Tray," date unknown.
Photograph of "Plastic Framed in Wood Tray," date unknown.

* cited by examiner

*Primary Examiner* — Jiping Lu
(74) *Attorney, Agent, or Firm* — Heslin Rothenberg Farley & Mesiti P.C.; Brett M. Hutton, Esq.

(57) ABSTRACT

A tray, for example, a drying tray, a method for drying, and a structural member engagement system are provided. The drying tray includes at least one perforated panel; and a frame adapted to support the perforated panel. The frame may include a plurality of interconnecting plastic support members adapted to receive the perforated panel. The tray may be used to dry fruits, vegetables, fish, and meat. A method of using the tray and a structural member engagement system are also disclosed The member engagement system includes a first elongated member, a second elongated member, and a plug and pin adapted to engage the first member with the second member.

21 Claims, 11 Drawing Sheets

LONG RAIL

DRYING TRAY AND METHOD OF USE

CROSS-REFERENCE TO RELATED APPLICATION

This application claims priority from pending U.S. Provisional Patent Application 60/988,242, filed on Nov. 15, 2007, the disclosure of which is included by reference herein in its entirety.

BACKGROUND OF THE INVENTION

1. Field of the Invention

The present invention generally relates to trays, a tray construction, and methods of using trays. More particularly, the present invention relates to a drying or dehydration trays and their methods of use, for example, in drying produce such as fruits or vegetables.

2. Description of Related Art

Between 1910 and 1920, L. N. Miller invented a box-like dryer for drying produce. The dryer was heated artificially by oil and included a large fan capable of high air velocity, humidity shutters, and bleeder vents. This was the predominant design for dryers through the 1940s and spawned many variations.

In the 1960s, scientists at the University of California at Davis developed the now common overhead return "Tunnel Dryer." Variations of this design are now in use throughout the U.S. and overseas. When using the Tunnel Dryer, products to be dried are placed on wooden trays measuring 3 feet×6 feet that are stacked 40 trays high onto rail carts. The carts are wheeled into the tunnels for processing.

The Four Phases of Hot Air Dehydration

There are typically four phases in the hot air dehydration of produce. The first phase is known as "raising the core temperature." In the first phase of raising the core temperature, the product is warmed as fast as possible, without case hardening the product to within 10 to 20 degrees of the process air temperature. In the field of the invention, "case hardening" is an undesirable thermal treatment or over heating of the product whereby the permeability of the surface or skin of the product, for example, fruit, is decreased or eliminated. For example, case hardening can undesirably seal the outer surface of a product and prevent moisture from escaping from the product during drying. In the counter flow configuration, the wet fruit is placed in the cool end and is subjected to very wet air that has lost 20 degrees or more by passing through the length of the Tunnel. This wet air transfers heat very fast and as the cart moves forward in the dryer, the process air temperature rises and humidity drops. This accelerates the transition to the second phase.

In the Parallel flow configuration, the wet cart is placed in the hot end and the product is immediately subjected to the high temperatures and low humidity of the high-pressure end of the tunnel dryer. Rather than pulling the cart with the product when it is dry (counter flow), parallel flow requires that in less than two hours another cart must be placed in the hot end of the tunnel to prevent the produce on the previous cart from case hardening. Thus, the wet product drives the dehydration process rather than the dry product. As each cart is placed in the high-pressure end, a charge of wet cool air bathes all of the cars behind it for a few minutes. This dehydration and re-hydration cycle continues throughout the process.

In the second phase of hot air dehydration, that is, "Rapid Dehydration," the moisture content of the product is in near free fall. To maximize production, moisture inside the dryer needs to be controlled. As a rule, the moisture content of the process air when drying most products, measured at the high-pressure end, should be 17% to 19%. After the air passes through the dryer, the relative humidity at the cool end should be between about 35% and 50%. Since each product is different, the processing conditions for each product may vary.

In the third phase of hot air dehydration, that is, the "Transition," is the most critical phase in dehydration, in regards to possible damage to the product. The high rate of moisture release experienced in the second phase slows down to a crawl. Most of the water in the product is substantially gone. Capillary action at the cellular level now provides the majority of the free water being driven off. The evaporative cooling that has kept the core temperature of the product well below the process air temperature slows as well. Case hardening, cooking, and carmelization are all very possible as the product passes through the transition phase.

In the fourth and final phase of hot air dehydration, that is, the "Bake Out," is characterized by a slow reduction in the product moisture content. This phase is normally the longest and, depending upon the target moisture content, may include over half the dwell time. Carmelization is still a threat in the last phase as well.

Batch Drying

Of the three ways to use a Tray Dryer, "Batch Drying" is the simplest and most commonly used. Batch drying refers to the loading of the tray dryer with all of the product-laden wooden or stainless steel trays and carts at one time and drying the lot, without moving the carts within the dryer. While some products react well to this procedure, most do not. The loss of the even and consistent dehydration quality motivates most operators to investigate other drying protocols. The problem with batch drying is in the lack of uniformity of the environment the product is exposed to. Since the leading edge of the leading car "sees" (or is exposed to) a much different environment than that of the trailing cart, significant differences in moisture content can occur within the product. It is like drying the same product in two different dryers, each set at a different temperature.

Existing drying trays have been traditionally made from laminated, composite or hardwood with the following problems: wooden trays can absorb water, juice, flavors, and odors; wooden trays can harbor bacteria, microbes, nematodes, black algae, fungus, and other potential contamination; wooden tray's splinters and chips can contaminate the food product; wooden trays are hard to clean and products can be damaged and deformed when being scraped from the tray surface; wooden trays need to be screwed or nailed together, such fixtures can easily work free and contaminate products or jam handling systems; wooden trays can absorb heat quickly and burn or discolor the surface of the fruit that lays against the wood.

One alternative to wooden trays are stainless steel trays. Stainless steel trays are somewhat uncommon due to high cost, hard to release surface, high heat transfer burning fruits, and less than optimal footprint (smaller sized due to handling weight).

Due to the disadvantages of existing wood and metal tray technology, a need exists for providing a produce drying tray with improved performance and reliability than existing trays.

SUMMARY OF ASPECTS OF THE INVENTION

Aspects of the present invention provide stackable trays that can be used to dehydrate and/or rehydrate whole and cut fruit and vegetables (collectively, produce), meats, fish and other foods, for example, in a tunnel dryer/hydrator, by batch drying, or by sun drying. For example, aspects of the invention may be used to dehydrate products, such, as fruit, and then rehydrate the formerly dehydrated product. Moreover, aspects of the invention may also be used to dehydrate, rehydrate, and then re-dehydrate products to, for example, remove contamination, such as, wind-borne dust that may have accumulated during sun drying to, for example, removing debris from the folds of raisins.

According to aspects of the present invention, a polymer-based or plastic-based tray is provided having the following features and benefits: aspects of the invention meet or exceed FDA and USDA standards as safe food contact surfaces; aspects of the invention will not easily absorb or transfer flavors and odors and will not easily house or grow contamination; aspects of the invention can be produced with different deck options for increased or decreased air circulation, point contact, or even have molded-in advertising, such as, logos or other indicia, for example, that can be embossed and/or transfer onto the dried product; aspects of the invention will not easily crack or chip; aspects of the invention can be fabricated from polymers that can be loaded with other additives, such as, iron powder, to make them metal detectable to ensure against final product contamination; aspects of the invention have better surface lubricity to limit damage or deformed products when being released from the surface; aspects of the invention may have structural members that can be made from non-slip polymer options, such as, polycarbonate (PC) and/or acrylonitrile butadiene styrene (ABS) (or their equivalents), with or without fillers, or made with non-slip surface, for example, a diamond pattern surface, to limit slipping when stacking, handling, or conveying stacked trays (for example, conveying a stack of up to 40 trays high or higher), or can be inter-stacked with wooden trays.

One aspect of the invention is a drying tray comprising at least one perforated panel; and a frame adapted to support the perforated panel, the frame comprising a plurality of plastic interconnecting support members adapted to receive the perforated panel. In one aspect, the perforated panel comprises at least one plastic perforated panel, but may include a plurality of perforated panels. In one aspect, the tray is adapted to handle food, for example, fruit, vegetables, fish, and/or meat.

Another aspect of the invention is a method of drying food comprising mounting food on the tray recited above; and exposing the tray with the food to an atmosphere that will dry the food, for example, placing the tray with food in a heated enclosure or placing the tray with food in sunlight.

An additional aspect of the invention is a structural member engagement system comprising a first elongated structural member having an open end and a transverse hole; a second elongated structural member having a through hole adapted to receive the first elongated structural member, the second elongated member having a end surface having a hole; a plug adapted to be inserted into the open end of the first elongated member, the plug having a transverse hole; and a pin adapted to be inserted into the hole in the end surface of the second member and engage the transverse hole in the first member and the transverse hole of the plug to substantially engage the first member with the second member. In one aspect, the first member and the second member comprise members of a support frame, for example, a frame for a food drying tray. In another aspect, the first elongated structural member and the second elongated structural member comprise plastic members.

These and other aspects, features, and advantages of this invention will become apparent from the following detailed description of the various aspects of the invention taken in conjunction with the accompanying drawings

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

DETAILED DESCRIPTION OF ASPECTS OF THE INVENTION

Figure 1:
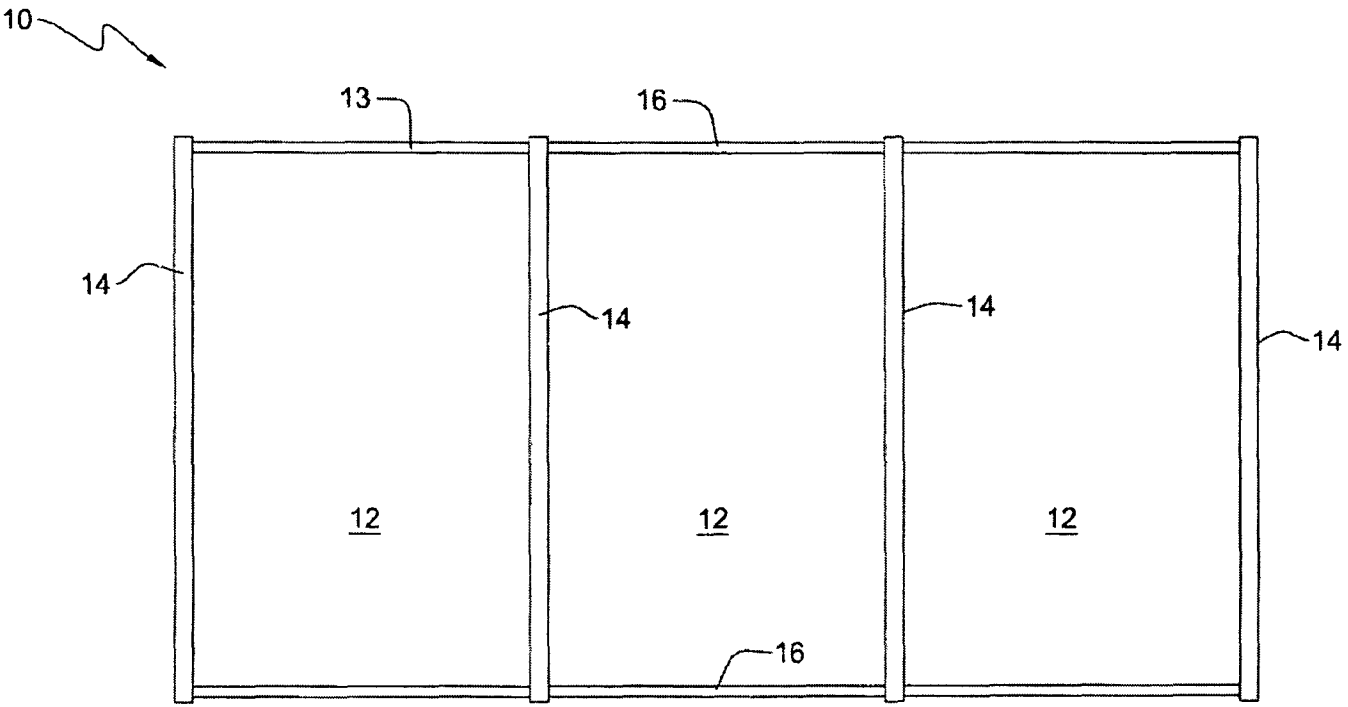
FIG. 1 is a plan view of a produce drying tray according to one aspect of the invention.

FIG. 1 is a plan view of a produce drying tray 10 according to one aspect of the invention. Though tray 10 may be used for a broad range of applications, including for transport, storage, or other handling of miscellaneous articles, according to one aspect of the invention, tray 10 may be used to retain produce, for example, fruits and vegetables, while the produce is dried, for example, in the production of dried fruits, such as prunes, or dried vegetable, such as, sun-dried tomatoes.

According to aspects of the present invention, tray 10 comprises one or more panel sections, deck panels, or panels 12 and a support frame 13 adapted to support the panels 12. Frame 13 comprises a plurality of lateral support members 14 and a plurality of longitudinal support members 16, for example, elongated support members. Though in one aspect of the invention, frame 13 may be provided as an assembly of inter-engaging members 14 and 16, in one aspect, frame 13 may be provided as a substantially unitary construction, for example, comprising a substantially one-piece structure. Panels 12 may typically be perforated, for example, having a regular pattern of perforations (not shown in FIG. 1, but see FIG. 2 for an example of perforations) adapted to allow a gas, for example, drying air, to pass through the perforations and promote drying of the produce (not shown). Though in one aspect of the invention, panels 12 are made from a plastic or a polymer, in another aspect of the invention, panels 12 may be made from wood or metal, and be adapted to engage frame 13. However, in one aspect of the invention, panels 12 are made from a plastic or polymer to ensure durability and minimize damage or deterioration during use that characterizes prior art wooden panel construction.

Figure 2:
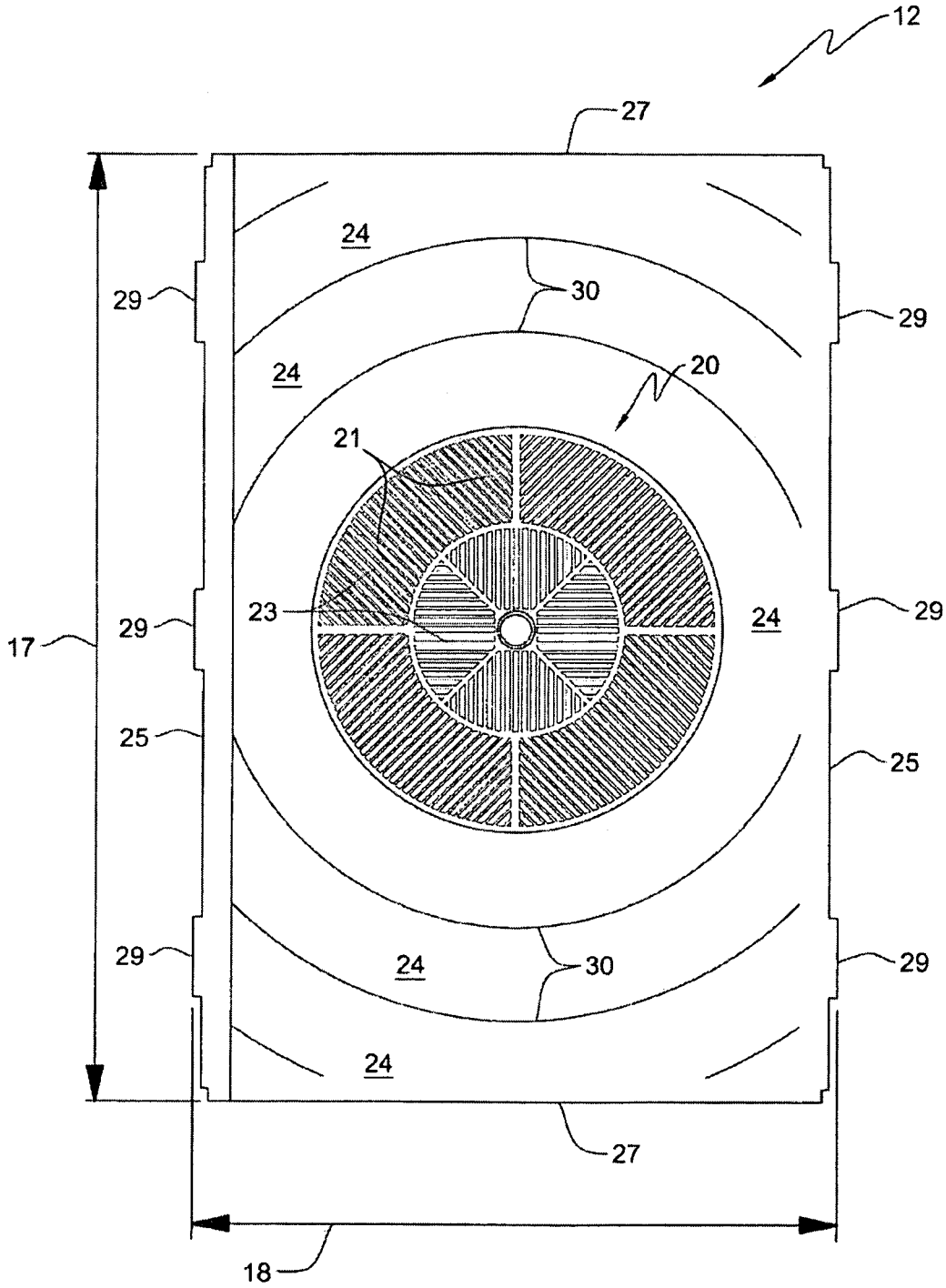
FIG. 2 is a plan view of a panel used in the produce drying tray shown in FIG. 1.

FIG. 2 is a plan view of a panel 12 used in the produce drying tray 10 shown in FIG. 1. As shown, panel 12 may typically be generally rectangular in shape, though other conventional, square, round, or polygonal shapes may also be used. The sized of panel 12 may vary depending upon the application for which tray 10 is used. Panel 12 may have a thickness ranging from about 0.125 inches to about 2 inches, but is typically between about 0.25 inches to about 0.50 inches, for example about 0.25 inches in thickness. Panel 12 may typically have a length 17 and a width 18 ranging from bout 1 foot to about 12 feet, but typically ranges from about 2 feet to about 3 feet. For example, length 17 may be about 3 feet and width 18 may be about 2 feet.

As shown in FIG. 2, panel 12 may include outside edges, for example, longitudinal edges 25 and lateral edges 27, adapted to engage support members 14 and 16. For example, though edges 25 and 27 may be so adapted, as shown in FIG. 2, edges 25 on panel 12 may include one or more projections 29 adapted to engage members 14 or 16 (as will be discussed below). Projections 29 may be circular, rectangular, square, or polygonal depending upon the means of engagement with members 14 and 16. As shown in FIG. 2, in one aspect, projections 29 may comprise elongated rectangular projections having a thickness about the same as the thickness of panel 12, or possibly thinner, and a length ranging from about 1 to about 12 inches, typically, about 2 to about 6 inches, for example, about 2.87 inches.

According to aspects of the invention, panel 12 may be made from wood, metal, or plastic. However, in one aspect of the invention, panels 12 are may preferably may be made from plastic, for example, one or more of the following plastics: a polyamide (PA), for example, nylon; a polyamide-imide; a polyethylene (PE); a polypropylene (PP); a polyester (PE); a polytetraflouroethylene (PTFE); an acrylonitrile butadiene styrene (ABS); a polycarbonate (PC); or a vinyl, such as, polyvinylchloride (PVC), among other plastics. In one aspect of the invention, panel 12 is made from fiber re-enforced plastic (FRP), for example, fiber-reinforced polypropylene, such as, chemically-coupled long-glass polypropylene. In another aspect, panel 12 may be made from filled polyethylene. In one aspect of the invention, panel 12 may be provided with an emboss finish to reduce surface tension on panel 12, for example, a 0.3 mm emboss finish.

Figure 3:
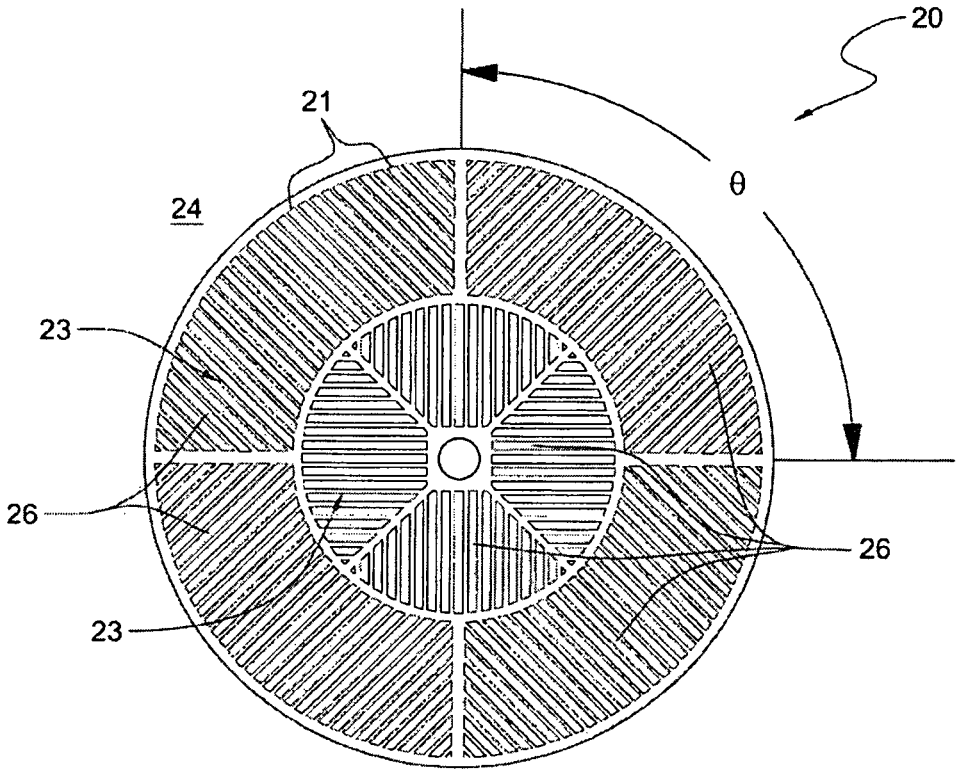
FIG. 3 is a detailed view of panel perforation pattern that can be used for the panel shown in FIG. 2 according to one aspect of the invention.

As shown in FIG. 2, panel 12 typically includes a plurality of perforations or vents 21, for example, a pattern 20 of a plurality perforations 21 uniformly arranged about panel 12 to provide flow paths for drying air, for example, heated oven air. FIG. 3 provides a detailed view of one perforation pattern 20 that can be used for the panel 12 shown in FIG. 2 according to one aspect of the invention. According to one aspect of the invention, perforation pattern 20 may comprise a plurality of annular regions 24 radiating outward from a generally central location of panel 12. As shown in FIG. 3, only two representative annular regions 24 are shown. According to aspects of the invention, annular regions 24 may extend to the approximately the edges 25 and 27 of panel 12, depending upon the shape of panel 12. For example, unperforated regions may be provided along edges 25 and 27 to accommodate engagement with members 14 and 16 (not shown in FIG. 2).

As shown in FIGS. 2 and 3, panel 12 may include a plurality of perforations 21, for example, elongated slots, wherein within each region 24 the direction of orientation of perforations 21 varies, for example, in a regular pattern. For example, as shown in FIG. 3, each region 24 may include a plurality of sub-regions 26 having a regular array of perforations 21 wherein the orientation of perforations 21 varies between sub-regions 26. Each annular region 24 may comprise one or more sub-regions 26, for example, four sub-regions as shown in FIG. 3, where the orientation of two adjacent sub-regions 26 may vary by an angle, θ, between sub-regions. The angle θ may vary from about 0 to about 180 degrees, but as shown in FIG. 3, θ may be about 90 degrees. According to aspects of the invention, the length of each perforation 21 may vary depending upon the diameter of regions 24 and the number of sub-regions 26 within regions 24. In one aspect of the invention, the orientation and size of perforations 21 are selected to facilitate the manufacture of panel 12, for example, to facilitate fabrication by injection molding panel 12.

Figure 2A:
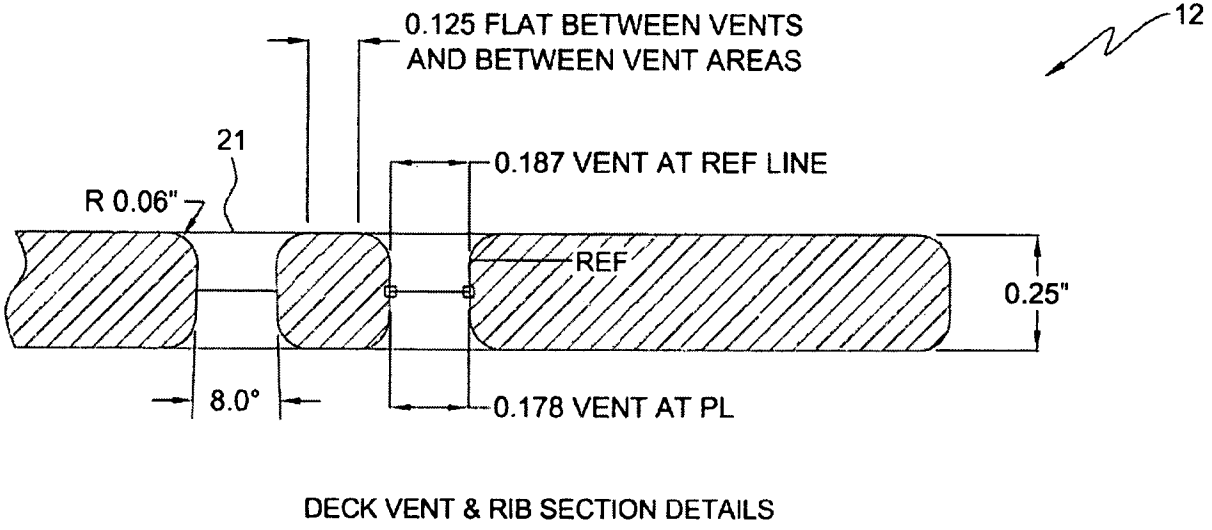
FIG. 2A is a typical detailed cross section of the panel vents shown in FIG. 2.

FIG. 2A is a detailed cross section of the panel 12 shown in FIG. 2. FIG. 2A illustrates the typical dimensions of a perforation or vent 21 according to one aspect of the invention.

Though shown as slots in FIGS. 2 and 3, perforations 21 may be made from any convenient shape, for example, circular, rectangular, or square holes; or elongated slots, for example, having rounded or square slot ends. In one aspect, perforations 21 may comprise a combination of two or more hole shapes, for example, circular holes and elongated slots. In one aspect, perforations 21 may be chamfered to facilitate the flow of air there through. In the aspect of the invention shown in FIG. 3, perforations 21 may comprise elongated slots having a length ranging from about 0.25 inches to about 6 inches, and having a width ranging from about 0.125 to about 1 inch, for example, about 0.1875 inches. The ends of all perforations or slots 21 may typically be rounded.

As shown in FIG. 3, panel 12 may also include a plurality of ribs 30, for example, a plurality of arcuate ribs, positioned between annular regions 24. Ribs 30 may be rounded, square, or rectangular in cross section and typically have a height about the surface of panel 12 of at least 0.125 inches, for example, about 0.125 to about 0.50 inches.

Panels 12 may be fabricated from a broad range of processes, for example, by machining stock sheets; molding, for example, injection molding; and the use of structural foam, among other methods.

Figure 5:
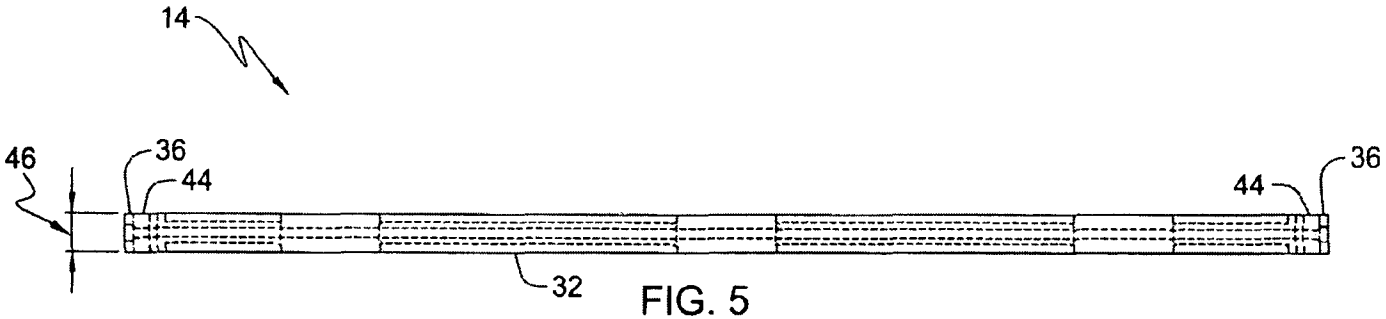
FIG. 5 is a top plan view of the lateral support member shown in FIG. 4.
Figure 4:
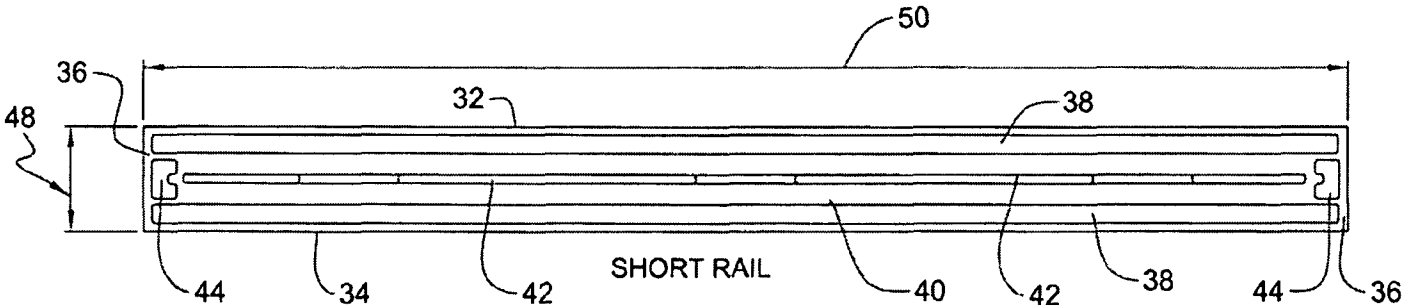
FIG. 4 a side elevation view of an lateral support member according an aspect of the invention.
Figure 7:
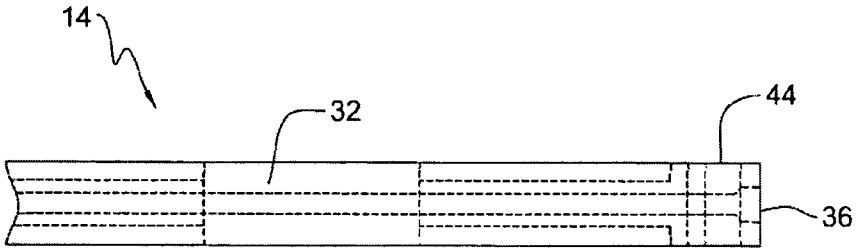
FIG. 7 is a detailed top plan view of the lateral support member shown in FIG. 5.
Figure 6:
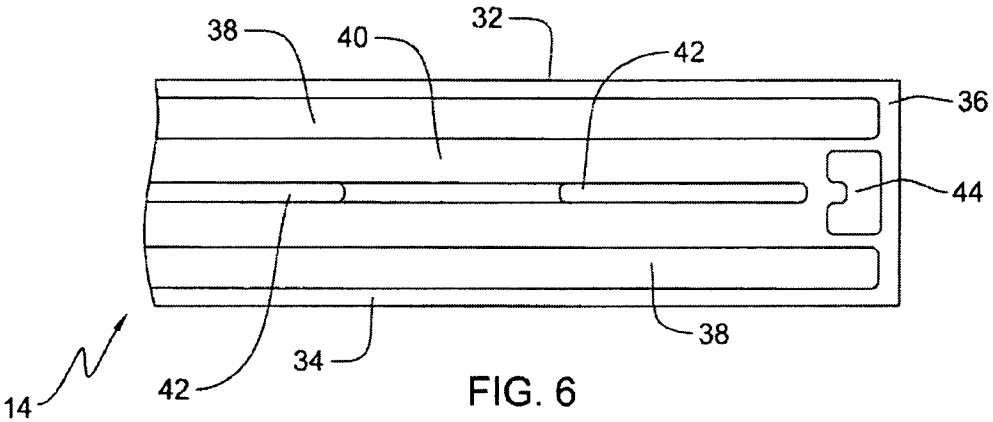
FIG. 6 is an detailed side elevation view of the lateral support member shown in FIG. 4.

FIG. 4 a side elevation view of an lateral support member 14 according an aspect of the invention. FIG. 5 is a top plan view of lateral support member 14 shown in FIG. 4. FIG. 6 is an detailed side elevation view of the lateral support member 14 shown in FIG. 4 and FIG. 7 is a detailed top plan view of the lateral support member shown in FIG. 5. As shown in FIGS. 4 and 5, support member 14 comprises an elongated member adapted to engage longitudinal support member 14 and panel 12. Member 14 includes an upper flange 32, a lower flange 34, and end flanges 36, elongated recesses 38, and a central boss 40. Member 14 also includes means for engaging support member 16 and panel 12. As shown in FIGS. 4-7, member 14 may include elongated slots 42 adapted to engage panel 12, for example, adapted to engage projections 29 on panel 12, and through holes 44 adapted to engage longitudinal members 16, as will be discussed below.

Support member 14 may be fabricated from one or more of the plastics identified above with respect to panel 12. In one aspect, member 14 may be fabricated from recycled nylon or polycarbonate.

The size of member 14 may vary depending upon the application in which tray 10 is used. For example, member 14 may have a thickness 46 ranging from about 0.50 inches to about 3 inches, but is typically between about 1 inch and about 2 inches thick, for example, about 1.13 inches in thickness. Member 14 may typically have a width 48 ranging from about 1 inch to about 12 inches, but is typically between about 2 inches and about 6 inches wide, for example, about 3.13 inches in width. Member 14 may typically have a length 50 ranging from about 1 foot to about 12 feet, but is typically between about 2 feet and about 6 feet in length, for example, about 36.50 inches in length.

Figure 8:
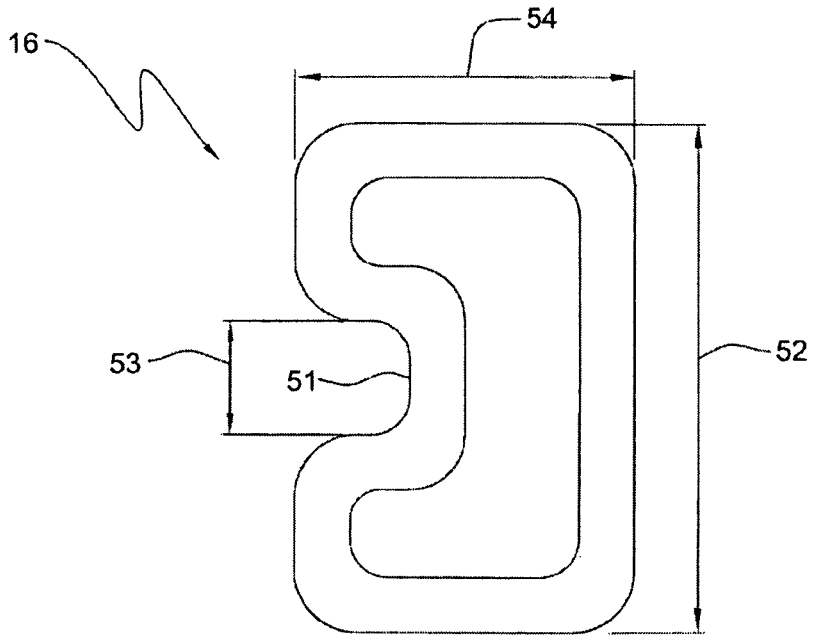
FIG. 8 is a cross sectional view of a longitudinal support member according to one aspect of the invention.

Member 14 may be fabricated from a broad range of processes, for example, by machining bar stock; by molding, for example, injection molding, by extrusion; or by forging, among other methods FIG. 8 is a cross sectional view of a longitudinal support member 16 according to one aspect of the invention. As show in FIG. 8, member 16 may be a hollow member having a generally square or rectangular cross section, though in one aspect, member 16 may not be hollow, but solid. As shown in FIG. 8, member 16 is typically adapted to engage panel 12 and lateral support member 14. For example, member 16 may include a recess or a projection 51 adapted to engage panel 12. As shown in FIG. 8, in one aspect, member 51 may include a recess 51 sized to accept panel 12, for example, having and internal width 53 sized to receive the width of panel 12. Width 53 may vary from about 0.125 inches to about 2 inches, depending upon the thickness of panel 12. In one aspect, width 53 may be about 0.25 inches.

In addition, longitudinal member 16 may be shaped to engage lateral member 14. For example, the shape or envelope of member 16 may be such that member 14 engages a hole in member 12. As shown more clearly in FIGS. 9-11 below, member 16 may be shaped to engage though hole 44 in lateral member 14 and member 16 may also be adapted to be secured to member 14.

Support member 16 may be fabricated from metal, for example, steel, stainless, steel, aluminum, or titanium, among other structural metals, or one or more of the plastics identified above with respect to panel 12. In one aspect, support member 16 may be fabricated from fiber-reinforced plastic. In another aspect, support member 16 may be metallic and then dipped to coated to prevent oxidation, for example, a carbon steel member may be dipped in PVC, coated with nickel, coated with powder, or a combination thereof. In one aspect, members 16 may be coated fiber-reinforced plastic, for example, to prevent damage from sulfur that may be present. Member 16 may also comprise a coated or dipped metal, for example, to minimize or prevent rusting. In one aspect, member 16 may be made from a powder coated metal, pultruded FRP or fiberglass filled polymers, for example, for operations that require higher tensile strength to carry a stack of trays by the rails using a fork-lift or to pick single trays from the stack using a mechanical handling devise.

Member 16 may also be fabricated from a broad range of processes, for example, by machining bar stock; by molding, for example, injection molding; by extrusion; by pultrusion; or by forging, among other methods.

The size of member 16 may vary depending upon the application in which tray 10 is used. For example, member 16 may have a height 52 ranging from about 0.50 inches to about 3 inches, but is typically between about 1 inch and about 2 inches thick, for example, about 1.13 inches in thickness. Member 16 may typically have a width 54 ranging from about 0.25 inches to about 3 inches, but is typically between about 0.5 inches and about 2 inches wide, for example, about 0.75 inches in width. Member 16 may typically have a length ranging from about 1 foot to about 12 feet, but is typically between about 2 feet and about 6 feet in length, for example, about 24 inches in length.

Figure 9:
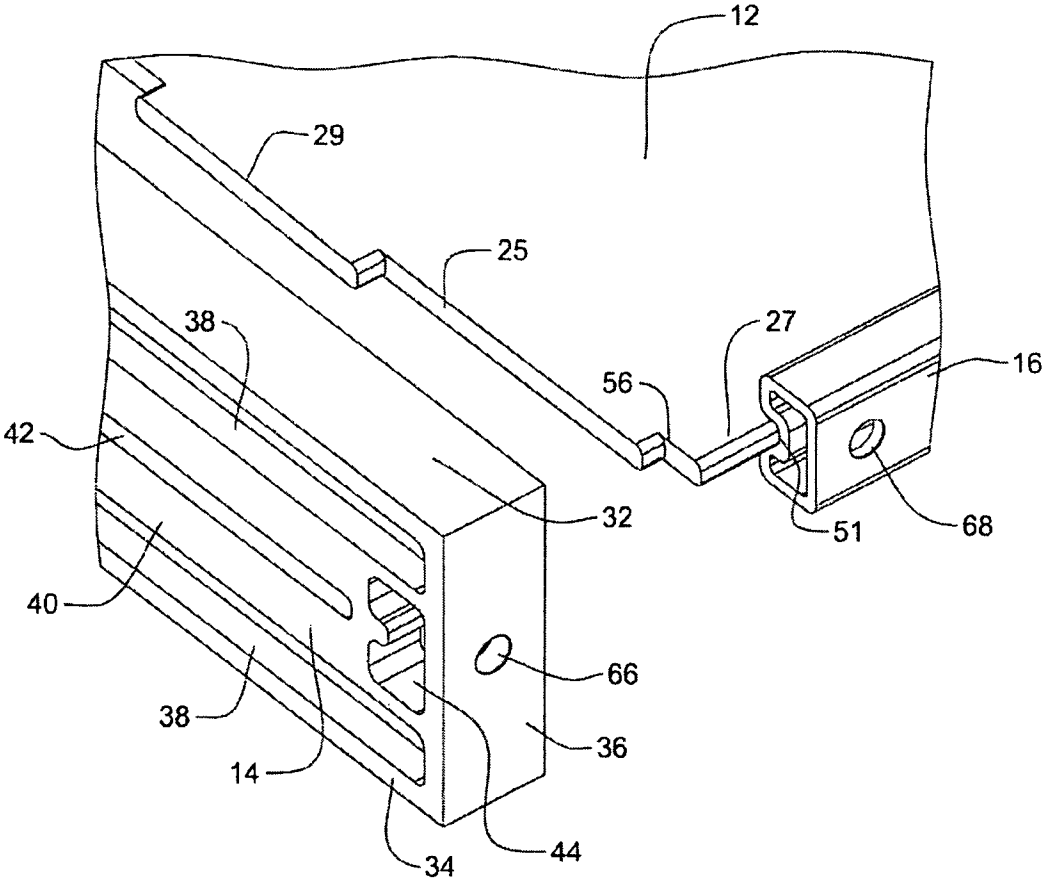
FIG. 9 is a partial exploded perspective view of the drying tray shown in FIG. 1.

FIG. 9 is a partial exploded perspective view of the drying tray 10 shown in FIG. 1. FIG. 9 illustrates the typical interengagement of a member 14 and a member 16 with a panel 12 according to one aspect of the invention. For example, as shown in FIG. 9, the edge 27 of panel 12 may engage recess 51, for example, loosely, snugly, or with an interference fit, in longitudinal member 16. In addition, projections 29 on edge 25 of panel 12 may engage, again, loosely, snugly, or with some interference fit, with slots 42 in lateral member 14. As also shown in FIG. 9, according to aspects of the invention, longitudinal member 16 may engage through hole 44 in lateral member 14, for example, loosely, snugly, or with some interference fit. As also shown in FIG. 9, panel 12 may include one or more clearance notches 56 to enhance engagement of panel 12 with members 14. For example, notches 56 may reinforce the engagement of panel 12 with the slot 42 in member 14 by providing an additional degree of engagement with slot 42 over and above the engagement of projection 29 with slot 42, to provide a more rigid, square structure.

In one aspect of the invention, longitudinal member 16 may terminate in or around through hole 44 in member 14; however, in another aspect of the invention, longitudinal member 16 may extend through lateral member 14 and, for example, terminate in another lateral member 14. That is, in one aspect of the invention, longitudinal member 16 shown in FIG. 1 may comprise one member 16 engaging one or more members 14 or two or more members 16 each engaging two or more members 14.

Figure 11:
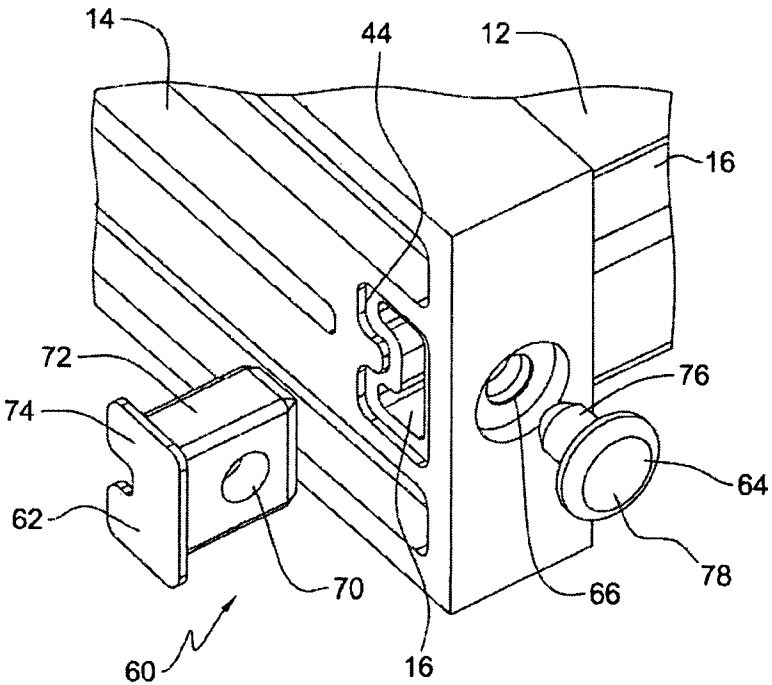
FIG. 11 is an exploded perspective view of the member-to-member engagement arrangement shown in FIG. 10.
Figure 10:
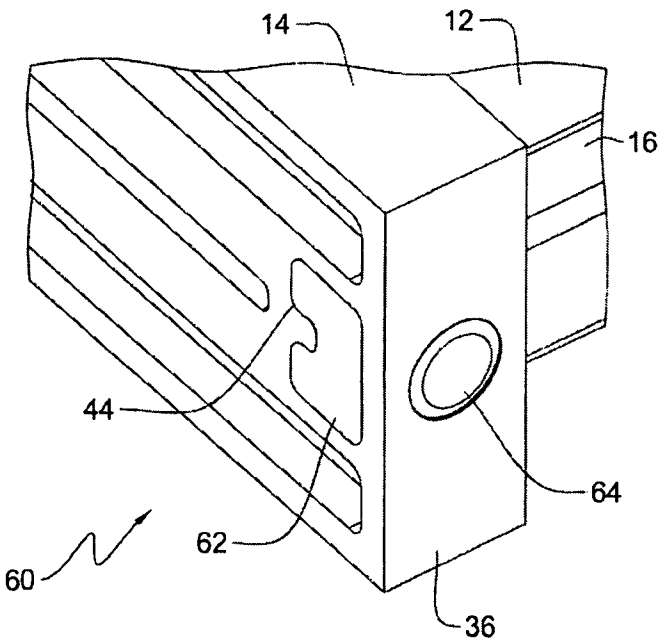
FIG. 10 is a perspective view of a detail of a member-to-member engagement arrangement according to one aspect of the invention.

FIG. 10 is a perspective view of a detail of a member 14 to member 16 engagement arrangement or system 60 according to one aspect of the invention. FIG. 11 is an exploded perspective view of the member-to-member engagement arrangement 60 shown in FIG. 10. As shown in FIGS. 10 and 11, according to one aspect of the invention, members 14 and 16 may be adapted to engage each other, for example, securely engage each other, whereby a relatively sturdy, secure, and robust assembly of panel 12 (not shown), lateral member 14, and longitudinal member 16 is provided. That is, according to one aspect of the invention, a sturdy produce drying tray 10 having one or more panels 12 and interlocking support members 14 and 16 is provided.

As shown in FIGS. 10 and 11, in engagement arrangement 60, lateral member 14 may be securely engaged with longitudinal member 16 by means of a plug 62 adapted to be inserted into an open end of member 16 and a pin 64 adapted to be inserted into a hole 66 in member 14 and engage a hole 68 in member 16 (see FIG. 9) and a hole 70 in plug 62. As shown, hole 44 in member 14 may be shaped to receive member 16, for example, hole 44 may have a shape that mimics the outside surface of member 16, though any shape of hole 44 that can receive member 16 may be used.

Plug 62 may typically be a metallic or plastic plug, for example, fabricated from one or more of the plastics listed above with respect to panel 12, that is shaped to be inserted into an open end of member 16. In one aspect, plug 62 may be fabricated from recycled nylon. Plug 62 may have a shaft 72 and a cap 74. Shaft 72 may be round, rectangular, square, or polygonal depending upon the shape of open end of member 16. In one aspect, plug 62 may loosely or snugly engage the open end of member 16, for example, plug 62 may be press fit into member 16. Cap 74 may be integrally mounted to shaft 72 and provide a stop to the insertion of plug 62 into member 16, and may also provide a means for removing plug 62.

Pin 64 may typically includes shank 76 and a cap 78. Pin 64 may also typically be a metallic or plastic pin, for example, fabricated from one or more of the plastics listed above with respect to panel 12, that is shaped to be inserted into a hole 66 in member 14 and engage hole 68 and hole 70. In one aspect, pin 64 may be fabricated from recycled nylon. Shank 76 may be round, rectangular, square, or polygonal and is shaped to be inserted into the holes 66, 68, and 70. In one aspect, pin 64 may loosely or snugly engage holes 66, 68, and 70; for example, pin 64 may be press fit into at least hole 66. Cap 78 may be integrally mounted to shank 76 and provide a stop to the insertion of pin 64 into hole 66, and may also provide a means for removing pin 64. In one aspect, hole 66 is recessed, for example, hole 66 is counter-bored or counter-sunk to allow cap 64 to be positioned in the recess whereby cap 64 does not project beyond the surface of (for example, is flush with) end flange 36, as shown in FIG. 10.

Aspects of the present invention provide stackable trays 10 that can be used to dehydrate and/or rehydrate whole and cut fruit, meats, vegetables, fish and other foods, for example, in a tunnel dryer/hydrator, by batch drying, or by sun drying Aspects of the invention can be made as a single molded unit or an assembled part. The members 14 and 16 and panel 12 may be designed to be interchangeable with wooden parts, for example, in case a user wants to make hybrid trays from both plastic and wooden components. Each polymer part (panel 12 and members 14 and 16) may be designed to be interchangeable with wooden trays so that the user can choose to purchase one component or several components that can interchange into the wooden parts, to replace broken parts, or integrate into existing tray inventory.

The support members 14, 16 may be made from an extruded and powder coated metal for customers who require additional beam strength, for example, if the bottom trays rails have to support the entire stack, for instance, if the stack of trays is being picked up by forklift forks instead of from under the end-rail beams where the weight would be transferred between the trays vertically through the stacked rails.

Aspects of the invention, may include quick release pins, for example, at the corners or the tray 10, to pin together both member 16 and members 14 and capture panels 12 and eliminate racking or nail/screw fixtures. These pins can have an oversized center to securely center locate them and easily be popped out of position using a simple tool.

Figure 12:
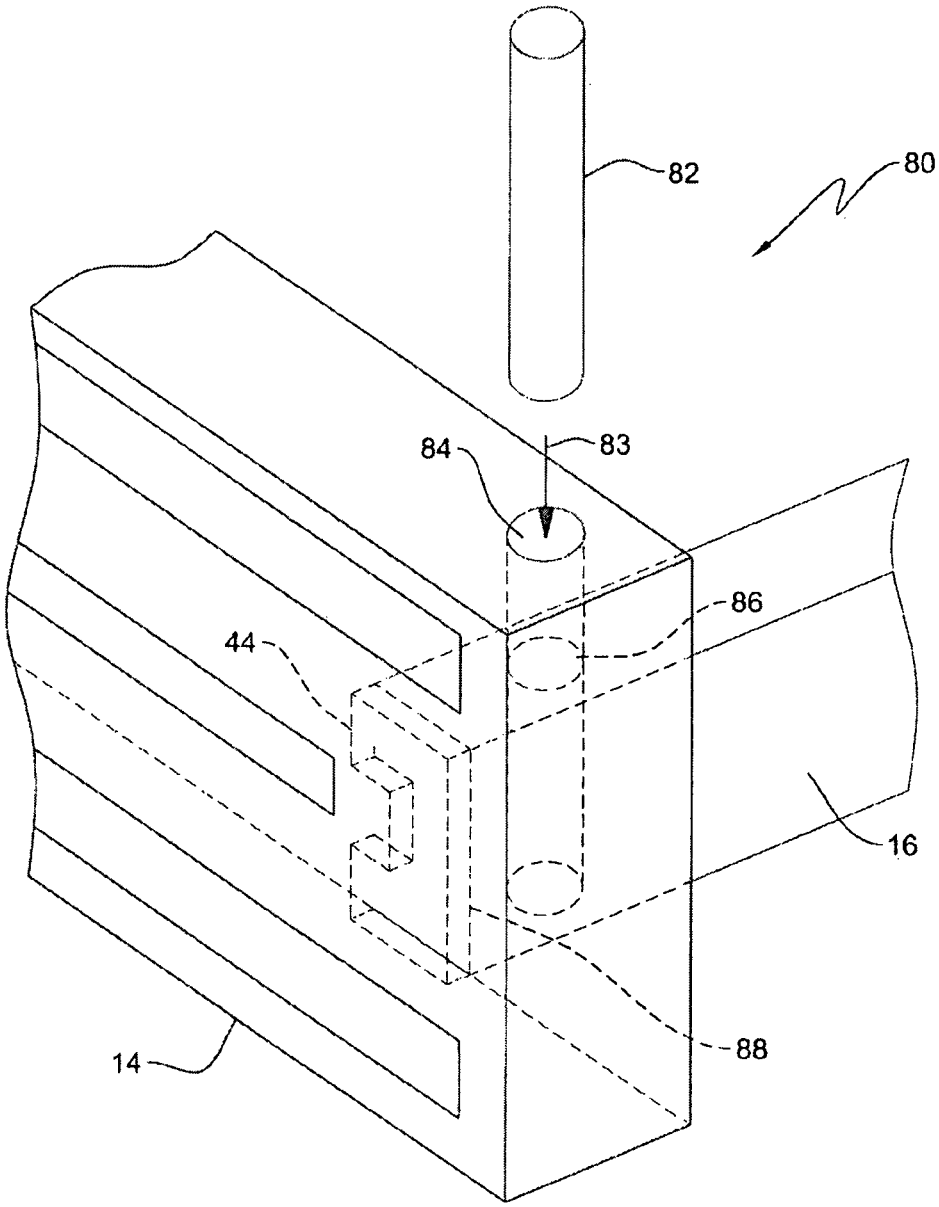
FIG. 12 is an exploded perspective view of another member-to-member engagement arrangement shown according to another aspect of the invention.

FIG. 12 is an exploded perspective view of another member-to-member engagement arrangement 80 according to another aspect of the invention. As shown in FIG. 12, according to one aspect of the invention, members 14 and 16 may be adapted to engage each other, for example, with the assistance of one or more pins 82. As indicated by arrow 83, pin 82 may be inserted into a blind or through hole 84 in member 14 and also engage a blind or through hole 86 in member 16. As shown, hole 44 in member 14 may be shaped to receive member 16, for example, hole 44 may have a shape that mimics the outside surface of member 16, though any shape of hole 44 that can receive member 16 may be used. Hole 44 may be a through hole, for example, where member 16 may extend through member 14, or a blind hole, for example, where hole 44 does not penetrate completely through member 14 but, for example, terminates at an end 88 within member 14.

Figure 16:
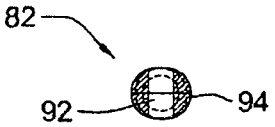
FIG. 16 is a cross sectional view of the pin shown in FIG. 13.
Figure 15:
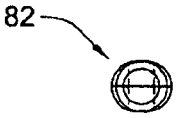
FIG. 15 is a top view of the pin shown in FIG. 13.
Figure 14:
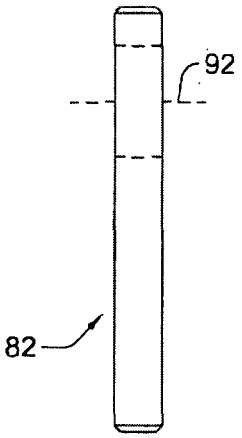
FIG. 14 is a side elevation view of the pin shown in FIG. 13.
Figure 13:
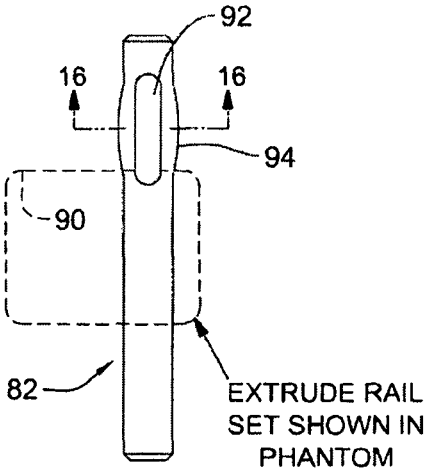
FIG. 13 is a front elevation view of one connecting pin for use in the arrangement shown in FIG. 12 according to an aspect of the invention.

FIG. 13 is a front elevation view of one connecting pin 82 that may be used in the arrangement shown in FIG. 12 according to an aspect of the invention. FIG. 14 is a side elevation view of pin 82 and FIG. 15 is a top view of pin 82 shown in FIG. 13. FIG. 16 is cross sectional view of pin 82 as viewed along section lines A-A shown in FIG. 13. Pin 82 may be a custom made pin or a commercially available pin. FIG. 13 includes an outline 90 in phantom of the relative position of member 16 when engaged with pin 82.

While in one aspect of the invention pin 82 may comprise a substantially uniform cylindrical body, for example, a solid or hollow cylindrical body or a polygonal cylindrical body, in one aspect, pin 82 may be tapered, for example, uniformly tapered from one end to the other. As shown in FIGS. 13 through 16, in one aspect, pin 82 may include at least one through hole or slot 92. Hole 92 may be a circular or polygonal hole and slot 92 may have radiused ends. Hole or slot 92 may be associated with expansions or bulges 94, for example, opposing expansions, in the substantially uniform outside surface, for example, outside diameter, of pin 82. The expansions or bulges 94 may comprise radiused expansions or bulges.

Figure 17:
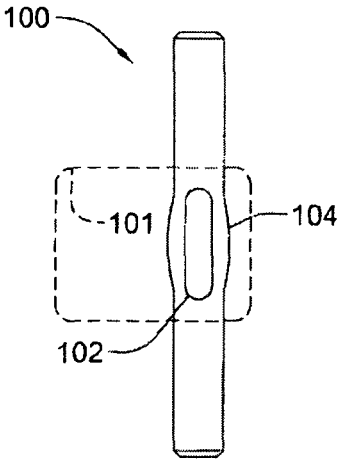
FIG. 17 is a front elevation view of another connecting pin for use in the arrangement shown in FIG. 12 according to an aspect of the invention.

According to one aspect of the invention, the one or more slots 92 having expansions 94 may be positioned anywhere along the length of pin 82. As shown in FIG. 13, slot 92 may be positioned closer to one end of pin 82 than to the opposite end of pin 82. For example, whereby when inserted into the member-to-member arrangement 80 shown in FIG. 12, after insertion, the slot 92 and expansion 94 may be substantially positioned in member 14. However, as shown in FIG. 17, the slot 92 and expansion 94 may also be substantially centrally positioned along pin 82 whereby, after insertion, the slot 92 and expansion 94 may be positioned at least partially, but may be substantially, within member 16. Pin 82 may be made from a plastic, for example, a nylon, a polyethylene, or a similar plastic; a metal, for example, iron, steel, stainless steel, aluminum, titanium, or another structural metal, or even from wood, for example, a hardwood or a softwood.

FIG. 17 is a front elevation view similar to FIG. 13 of another connecting pin 100 that may be used in the arrangement shown in FIG. 12 according to an aspect of the invention. Pin 100 may be substantially similar to pin 82 in size, shape, and material. FIG. 17 also includes an outline 101 in phantom of the relative position of member 16 when engaged with pin 100. Pin 100 may typically include at least one through hole or slot 102 which may be associated with one or more expansions or bulges 104, as described above, for example, a centrally located slot 102 and expansion 104, for instance, located at approximately the mid length of pin 100.

In one aspect, pin 82 or 100 may first be positioned in hole 84 shown in FIG. 12 whereby bulge or expansion 94, 104 abuts the surface of hole 84. Pin 82 or 100 may than be forcibly engaged with member 14, member 16, or both member 14 and 16, by forcibly inserting pin 82 or 100 into hole 84, for example, manually by means of hammer or mallet, or automatedly by a robot-type manipulator. According to one aspect of the invention, the interference fit between the bulge or expansion 94, 104 and the inside diameter of hole 84 and/or hole 86 may substantially rigidly retain pin 82 or 100 within hole 84 and/or 86, and substantially rigidly engage member 14 with member 16.

In another aspect, polymer or plastic panels 12 may absorb heat more slowly than wood so that tray 10 absorbs the heat faster to speed up the drying process using less energy to dry the product. In one aspect, gas bubbles may be added to the polymers to make them even more insulating (for example, using chemical blowing agents or dissolved gas technology such as Mucell into the molding) and resistant to thermal conductivity. For example, in experimental drying trials, prunes could be dried on a wooden tray reached 18% humidity, the prunes dried on plastic trays (under identical drying conditions and duration) achieved a 14~15% humidity. Thus aspects of the invention can provide a drying surface that dries the product more efficiently, either because of the increased air circulation or the polymers tendency to absorb less of the ambient heat.

Lateral support members 14 may be provided with recessed grip hand holds to support automatic and manual stacking while reducing member weight. Lateral support member 14 may also be cored out to reduce weight and allow more product surface area. Lateral support member 14 and longitudinal support member 16 may be made to capture panels 12 to eliminate racking, eliminate fastening screws and nails, and also increase sanitation.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

The invention claimed is:

1. A drying tray comprising:

at least one perforated panel; and a frame adapted to support and fully surround the perforated panel, the frame comprising a plurality of interconnecting plastic support members adapted to receive the perforated panel, the frame including a plurality of elongated one-piece lateral support members and two elongated longitudinal support members, and each lateral support member including a first lateral side, a second lateral side substantially opposing the first lateral side, a first end, a second end, a top surface that defines the top surface of the tray and a bottom surface that defines the bottom surface of the tray, wherein each of the longitudinal support members include a panel slot configured to accept at least a portion of the perforated panel therein, each lateral support member including a first panel slot in the first lateral side adapted to engage at least a portion of a perforated panel, each lateral support member including a second panel slot in the second lateral side adapted to engage at least a portion of a second perforated panel, wherein first and second lateral support members define opposing lateral sides of the tray, and the lateral support members define a thickness extending from the top surface to the bottom surface that is greater than a corresponding thickness of the longitudinal support members, and wherein a first longitudinal member includes a first end and a second end and defines a longitudinal side of the tray and is coupled to a medial portion of the thickness of the first and second lateral support members proximate the first ends thereof, and a second longitudinal member includes a first end and a second end and defines an opposing longitudinal side of the tray and is coupled to a medial portion of the thickness of the first and second lateral support members proximate the second ends thereof.

2. The tray as recited in claim 1, wherein the at least one perforated panel comprises a plurality of distinct perforated panels, the number of lateral support members is equal to one more than the number of perforated panels, and the lateral support members other than the first and second lateral support members positioned between adjacent perforated panels utilizing both of the first and second panel slots in the first and second lateral sides thereof to support the lateral sides of the perforated panels that are not supported by the first and second lateral support members.

3. The tray as recited in claim 1, wherein the plurality of interconnecting plastic support members comprise a plurality of integral support members providing a substantially unitary construction.

4. The tray as recited in claim 1, wherein the tray is adapted to handle food and be used in one of tunnel drying, tunnel dehydrating, and sun drying.

5. The tray as recited in claim 1, wherein the tray further comprises a plurality of plugs and pins adapted to engage the plurality of longitudinal members with the plurality of lateral members.

6. The tray as recited in claim 1, wherein the frame includes two distinct perforated panels and three lateral support members, the first lateral support member being coupled to the first longitudinal support member proximate the first end thereof and to the second longitudinal support member proximate the first end thereof, the second lateral support member being coupled to the first longitudinal support member proximate the second end thereof and to the second longitudinal support member proximate the second end thereof, a third lateral support member coupled to the first and second longitudinal support members at a position between the first and second lateral support members, a first perforated panel positioned between the first and third lateral support and the first and second longitudinal support members, and a second perforated panel positioned between the third and second lateral support members and the first and second longitudinal support members.

7. The tray as recited in claim 1, wherein the frame includes three distinct perforated panels and four lateral support members, the first lateral support member being coupled to the first longitudinal support member proximate the first end thereof and to the second longitudinal support member proximate the first end thereof, the second lateral support member being coupled to the first longitudinal support member proximate the second end thereof and to the second longitudinal support member proximate the second end thereof, and third and fourth lateral support members coupled to the first and second longitudinal support members at positions between the first and second lateral support members.

8. The tray as recited in claim 7, wherein a first perforated panel is positioned between the first lateral support member and the third lateral support member, a second perforated panel is positioned between the third lateral support member and the fourth lateral support member, a third perforated panel is positioned between the fourth lateral support member and the second lateral support member, and each perforated panel is positioned between the first and second longitudinal support members.

9. The tray as recited in claim 1, wherein the first and second longitudinal support members are provided in member apertures in the lateral support members that substantially correspond in shape to the outer shape of the longitudinal support members.

10. The tray as recited in claim 9, wherein the shape of the member apertures include a protrusion that mates within the panel recess of the longitudinal support member provided therein, and wherein the protrusion of each member aperture of each lateral support member is aligned with a plane defined by the at least one perforated panel.

11. The tray as recited in claim 9, wherein the lateral support members include pin apertures extending from an outer surface of the members to each member aperture and define first axes, the longitudinal support members include pin apertures that define second axes and that substantially correspond to the pin apertures of the respective lateral support members coupled thereto such that the first and second axes are aligned, and a removable pin positioned within each pin aperture of the lateral support members and corresponding longitudinal support members to couple the members to one another.

12. The tray as recited in claim 9, wherein the lateral support members include pin apertures that define first axes extending laterally from longitudinal side surfaces of the support members to at least a corresponding member aperture proximate the longitudinal side surfaces, the longitudinal support members include pin apertures that define second axes that substantially correspond to the pin apertures of the lateral support members coupled thereto such that the first and second axes are aligned, and a removable pin positioned within each pin aperture of the lateral support members and within each corresponding pin aperture of the longitudinal support members to couple the members to one another.

13. The tray as recited in claim 12, wherein each longitudinal support member includes a longitudinally extending opening that extends from lateral side surfaces thereof, a plug is positioned at least partially within each longitudinally extending opening and includes a pin aperture that substantially correspond to and aligns with the pin apertures of the corresponding lateral support member and longitudinal support member provided therein such that the pin apertures define third axes that are aligned with the second axis of the corresponding lateral support member and the third axis of the corresponding longitudinal support member, and wherein each removable pin is further positioned within the pin aperture of the plugs to couple the members and the plug to one another.

14. A drying tray as recited in claim 1, wherein each lateral support member includes at least two through holes adapted to engage the longitudinal support members.

15. A method of drying food comprising:

mounting food on the tray recited in claim 1; and exposing the tray with the food to an atmosphere that will dry the food.

16. The method as recited in claim 15, wherein exposing the tray to an atmosphere that will dry the food comprises placing the tray with food in sunlight or in a heated enclosure.

17. A drying tray comprising:

at least two distinct perforated panels defining two opposing lateral sides and two opposing longitudinal sides positioned between the lateral sides, the lateral sides including projections extending longitudinally therefrom; and a frame adapted to support and fully surround each of the distinct perforated panels, the frame comprising a plurality of detachably coupled distinct plastic support members adapted to receive the at least two perforated panels, the frame including at least three elongated one-piece lateral support members and two elongated longitudinal support members, each lateral support member including a first end, a second end, a top surface that defines the top surface of the tray and a bottom surface that defines the bottom surface of the tray, and each lateral support member including substantially opposing lateral sides extending between the top and bottom surfaces, and each of the two longitudinal support members including a first end and a second end, wherein the longitudinal support members define longitudinal sides of the tray and include a panel recess supporting the longitudinal sides of the at least two perforated panels therein, wherein first and second lateral support members define lateral sides of the tray and the other of the at least three lateral support members being positioned between the lateral sides of the tray and between adjacent perforated panels, each of the at least three lateral support members including panel slots on the opposing lateral sides thereof configured to support the lateral sides of the perforated panels therein on either of the lateral sides thereof, and the at least three lateral support members supporting the lateral sides of the at least two perforated panels via the panel slots therein, wherein the panel slots on the opposing lateral sides of each of the lateral support members extend in the longitudinal direction and include first recess portions and second recess portion, the second recess portions defining deeper recesses in the longitudinal direction than the first recess portions for supporting the projections extending from the lateral sides of the at least two perforated panels, and the first recess portions for supporting the portions of the lateral sides of the perforated panels that do not include the projections, and wherein a first longitudinal member is coupled to the lateral support members proximate the first ends thereof, and a second longitudinal member is coupled to the lateral support members proximate the second ends thereof.

18. A drying tray as recited in claim 17, wherein the tray includes two distinct perforated panels and three lateral support members, each of the first and second lateral support members utilizing only one of the recesses on the opposing lateral sides thereof to support one lateral side of one of the two perforated panels, and a third lateral support member being positioned between the two perforated panels and utilizing both of the slots on the opposing lateral sides thereof to support the other lateral side of each of the perforated panels.

19. A drying tray as recited in claim 17, wherein the tray includes three distinct perforated panels and four lateral support members, each of the first and second lateral support members utilizing only one of the slots on the opposing lateral sides thereof to support one lateral side of two of the three perforated panels, and third and fourth lateral support members each being positioned between adjacent perforated panels and utilizing both of the slots on the opposing lateral sides thereof to support the lateral sides of the perforated panels that are not supported by the first and second lateral support members.

20. A drying tray as recited in claim 17, wherein the tray includes four distinct perforated panels and five lateral support members, each of the first and second lateral support members utilizing only one of the slots on the opposing lateral sides thereof to support one lateral side of two of the four perforated panels, and third, fourth and fifth lateral support members each being positioned between adjacent panels and utilizing both of the slots on the opposing lateral sides thereof to support the lateral sides of the perforated panels that are not supported by the first and second lateral support members.

21. A drying tray as recited in claim 17, wherein the lateral support members define a thickness extending from the top surface to the bottom surface that is greater than a corresponding thickness of the longitudinal support members, the first longitudinal member is coupled to a medial portion of the thickness of the lateral support members, and the second longitudinal member is coupled to a medial portion of the thickness of the lateral support members.

* * * * *